United States Patent [19]

Tullos et al.

[11] 4,431,067

[45] * Feb. 14, 1984

[54] WIRELINE PROTECTOR WITH CLAMPING MECHANISM

[75] Inventors: Homan C. Tullos, Lafayette, La.; Dewey W. Woods, Livingston, Tex.

[73] Assignee: Kelly Bushing Tools, Inc., Lafayette, La.

[ * ] Notice: The portion of the term of this patent subsequent to Mar. 2, 1999 has been disclaimed.

[21] Appl. No.: 246,095

[22] Filed: Mar. 20, 1981

Related U.S. Application Data

[63] Continuation-in-part of Ser. No. 148,393, May 9, 1980, Pat. No. 4,317,491.

[51] Int. Cl.[3] ..... E21B 3/04

[52] U.S. Cl. ..... 175/57; 24/134 L; 175/195; 175/104

[58] Field of Search ..... 24/248 B, 249 R, 134 L; 175/57, 195, 104; 165/65 R; 174/135, 136; 16/108, 109; 248/47

[56] References Cited

U.S. PATENT DOCUMENTS

| | | | |
|---|---|---|---|
| 384,255 | 6/1888 | Havens | 24/134 L |
| 399,053 | 3/1889 | Landee | 24/134 L |
| 467,875 | 1/1892 | Kent | 24/134 L |
| 1,492,434 | 4/1924 | Doan | 24/134 L |
| 2,470,316 | 5/1949 | Miller | 24/134 L |

*Primary Examiner*—William F. Pate, III

*Attorney, Agent, or Firm*—LeBlanc, Nolan, Shur & Nies

[57] ABSTRACT

A wireline protector for protecting an electrical wireline used in a downhole drilling operation. During the operation of adding additional drill string members to the drill string, the electrical wireline is encased by and clamped within the wireline protector thereby guarding it against damage by any slippage of the slip members. The wireline protector includes an elongated section that is arranged to extend through the opening in the rotary table through which the drill string passes in such a manner so as not to interfere with the drill string and a second section substantially perpendicular to the elongated section. The elongated section has an elongated opening into which the portion of the wireline passing through the rotary table can be inserted so that it is substantially surrounded and guarded by the elongated section. After the wireline is inserted into this elongated section, a clamping member acts to grip the wireline so as to retain it in place. A locking latch also can be used for ensuring that the wireline does not slip out of the elongated section. The second section is arranged in engagement with the rotary table so as to maintain the wireline protector in place.

15 Claims, 9 Drawing Figures

Fig. 1
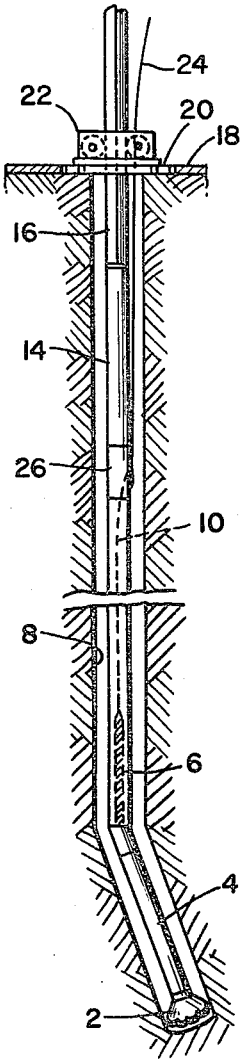
Fig. 2
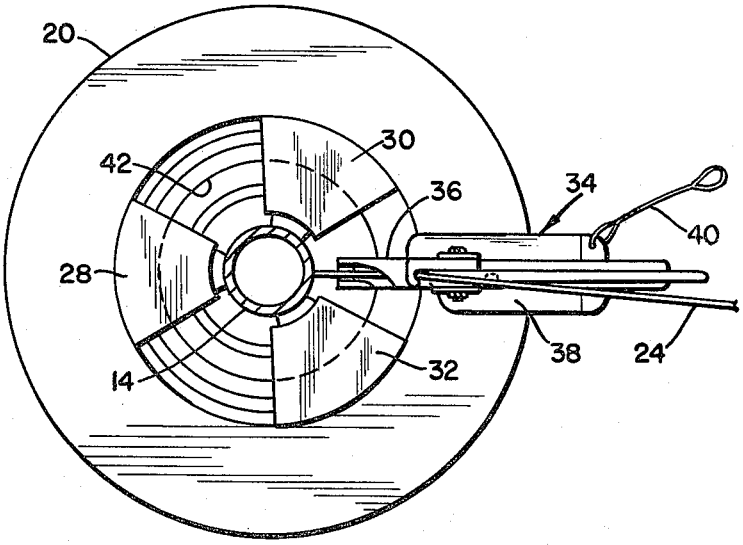
Fig. 3
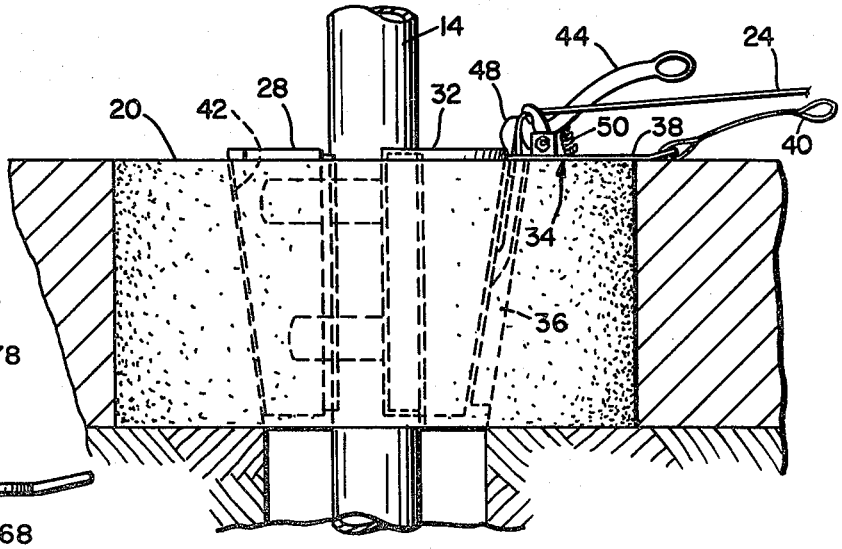
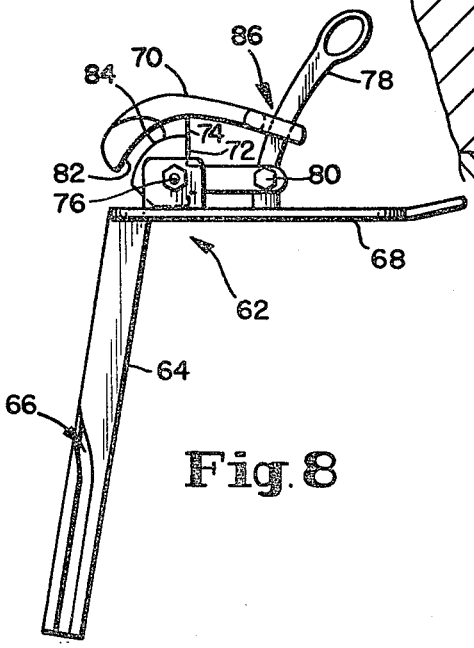
Fig. 8

WIRELINE PROTECTOR WITH CLAMPING MECHANISM

RELATED APPLICATION

The present invention is a continuation-in-part of U.S. patent application Ser. No. 148,393 entitled WIRELINE PROTECTOR and filed May 9, 1980, now U.S. Pat. No. 4,317,491. Such prior patent application is hereby incorporated by reference.

BACKGROUND OF THE INVENTION

The present invention relates to equipment for use during a downhole drilling operation.

During a downhole drilling operation, in the area of the downhole drilling bit there is usually arranged an electrical sensing member. This electrical sensing member serves to detect the path of the drilling operation so that appropriate corrections can be made to the drilling operation. An electrical wireline from a supply at the surface extends along the drilling string and is attached to the electrical sensing member. Typically, the wireline extends along the outside of the drilling string for a certain distance from the surface of the earth until it reaches a side entry sub assembly at which point it enters the interior of the drill string and travels through the drill string until it reaches the sensing member. Such side entry sub assemblies are manufactured by Sperry-Sun and are disclosed in U.S. Pat. No. 4,062,551.

The drill string assembly is attached at its upper end to a kelly which passes through a kelly bushing and the opening in the rotary table. As the drill bit advances into the earth, the kelly with the attached drill string moves downwardly with the bit. When the majority of the kelly has entered the hole being drilled, a new drill string member is attached. The drill string and the kelly with the kelly bushing are lifted out of the hole so as to bring the uppermost portion of the top drill string member up through the opening in the rotary table. A plurality of slips are then inserted between the rotary table and the top drill string member so as to secure the top drill string member and the attached drill string assembly to the rotary table. The kelly is then detached from the uppermost drill string member and an additional drill string member is inserted. Typically, one drill string members are inserted at a time. The kelly then is reattached and the drilling operation is continued.

When the top drill string member is secured to the rotary table by the slips, great care must be taken to avoid having any slippage of the slips which can result in damage to the electrical wireline. If the electrical wireline is either pinched or possibly even broken by the slips, the entire wireline must be removed from the drill hole. In order to remove the wireline, the drill string assembly must be removed from the ground until the point of location of the side entry sub assembly. The wireline then is removed and a new wireline inserted. Such an operation results both in having to discard a significant quantity of electrical wire, which can typically be on the order of 10,000 feet, and a time consuming operation for having to replace the electrical wireline. Such damage, therefore, further increases the cost of the drilling operation.

While various devices have been employed for protecting an electrical wireline during a drilling operation, these devices are neither capable nor were they developed for the purpose of resolving the above-described problems. Typical of the devices that have been used in drilling operations are those shown by the following U.S. Patents: No. 2,829,190 to Comlossy and No. 3,048,358 to Raulins. The patents to Comlossy and Raulins both illustrate clamp members that are attached to the drill string. The wireline is arranged within this clamp member and extends along the outer length of the drill string to the area of the drill bit. These devices are primarily designed to prevent the electrical wire from becoming twisted or wrapped around the drill string member as it is rotated and also to protect the wireline from being damaged by the drill string members within the hole being drilled. With the utilization of the side entry sub assembly, however, the electrical wireline passes through the center of the drill string members and hence the clamps disclosed by the patents to Comlossy and McCarthy are not needed.

When drilling under certain conditions, it is necessary to insulate the electrical wire from certain conditions that might occur during the drilling operation. For this purpose, U.S. Pat. No. 3,835,929 to Suman discloses encasing the electrical wireline within a special conduit that extends from the top of the hole being drilled down to the drilling bit along the ouside of the drill string assembly. Once again the types of problems that this patent seeks to avoid are largely solved by the use of the side entry sub assembly thereby rendering the use of the insulating tubing unnecessary.

Various other devices have been known in the art for shielding a cable as it passes between two points. Such devices are illustrated in the following U.S. Patents: No. 2,258,745 to Dewey et al.; No. 2,408,253 to Diebold; and, No. 3,716,733 to Keith et al. These devices, however, are not utilized in downhole drilling operations.

SUMMARY OF THE INVENTION

An object of the present invention is to avoid the potential damage to the electrical wireline that can occur during the downhole drilling operation as discussed above.

Another object of the present invention is to provide an improved device for protecting the electrical wireline from damage during the operation of adding additional drill string members to a drill string assembly utilized in a downhole drilling operation.

A further object of the present invention is to provide a wireline protector that will prevent the slips from touching the electrical wireline and cutting or pinching such wireline.

Still another object of the present invention is to provide a wireline protector for securly retaining and protecting the electrical wireline when the protector is used.

In order to achieve the objectives of the present invention, a wireline protector is utilized during the operation of adding additional drill string members to the drill string assembly. This wireline protector encases and retains the electrical wireline thereby preventing the slips from touching the wireline and cutting or pinching such line.

The electrical wireline protector includes an elongated section and a top section which is oriented so as to be approximately perpendicular to the elongated section. Preferably, the two sections should be respectively oriented so as to encompass an angle of slightly greater than 90°, ideally approximately 100°. The elongated section is the section that is arranged in the opening in the rotary table through which the drill string passes and is arranged within such opening so as to avoid being in interference with the drill string. The elongated section has an elongated opening into which the portion of the electrical wireline that passes through the rotary table can be inserted so as to be substantially surrounded by the elongated section. The top section lies on top of the rotary table in engagement with the rotary table and thereby maintains the wireline protector in place, i.e. prevents the wireline protector from sliding through the opening in the rotary table. In order to avoid any rotational movement of the wireline protector, the circumference of the elongated section should preferably be noncircular. The use of a noncircular circumference for the elongated section avoids any tendency of the wireline protector to roll within the opening in the rotary table.

The elongated opening in the elongated section can take any one of several different forms. This elongated opening can have a cross-sectional shape of a parallelogram. Alternatively, the cross-sectional shape of the elongated opening can be circular. While the access to the elongated opening can extend along a straight line, the path of the access can turn. If the access to the elongated opening does turn, preferably it turns by approximately 90°. Utilizing an embodiment where the access to the elongated opening does turn enables the wireline protector to be inserted into the opening and to then have at least some portion of the elongated section entirely wrapped around the electrical wireline thereby helping to ensure that it does not slip out of the elongated section.

To ensure that the electrical wireline is retained within the wireline protector, a clamping mechanism is provided for grasping and securing the wireline at the top of the elongated section. The clamping mechanism includes two relatively movable clamping members that can be spread apart for inserting the wireline between them. After insertion of the wireline, the two members are moved towards each other and securely grasp the wireline thereby preventing the wireline from slipping out of the protector and from slipping through the protector. Preferably one of the two clamping members is spring biased towards the other clamping member. In addition a latch member can be provided at the top of the elongated section for blocking off the side opening of the top of the section so that the wireline can not come out of the elongated section.

In an alternative embodiment, the movable clamping position can include a mechanism for locking it in its closed position, i.e. the position in which it firmly clamps the electrical wireline. Where the second member can be so locked then the spring biasing mechanism need not be included.

During the downhole drilling operation, when additional drill string members are to be added to the drill string assembly the electrical wireline protector of the present invention is utilized. The drill string assembly includes: the downhole drilling motor, an electrical sensing member, a drill string having at least one drill string member, a kelly attached to the upper end of the drill string, a rotary table having an opening through which the kelly and the drill string extend, and a supply of electrical wireline. The electrical wireline extends through the opening in the rotary table.

During the operation of adding additional drill string members, the kelly and the attached drill string are raised a sufficient distance that the top portion of the uppermost drill string member extends through the opening in the rotary table. A plurality of slip members are then inserted between the rotary and the drill string so as to secure the drill string to the rotary table. The wireline protector then is inserted through the opening in the rotary table with the electrical wireline being arranged and clamped into place in the elongated opening in the elongated portion of the wireline protector. The kelly then is detached from the uppermost drill string member and a new drill string member inserted between the kelly and the top drill string member. The wireline protector is retained in its position extending through the opening in the rotary table during this entire operation. After the new drill string member has been secured in place and the kelly attached, the drilling operation is continued. Upon resuming the drilling operation, the wireline protector is removed.

BRIEF DESCRIPTION OF THE DRAWINGS

FIG. 1 is a schematic view of a downhole drilling system with which the present invention is utilized.

FIG. 2 is a top plan view of a rotary table with the wireline protector of the present invention inserted through the opening in the table.

FIG. 3 is a cross-sectional side view of the rotary table with the inserted wireline protector of FIG. 2.

FIG. 8 is a side elevational view of another embodiment of a wireline protector of the present invention.

DESCRIPTION OF THE PREFERRED EMBODIMENTS

Figure 4:
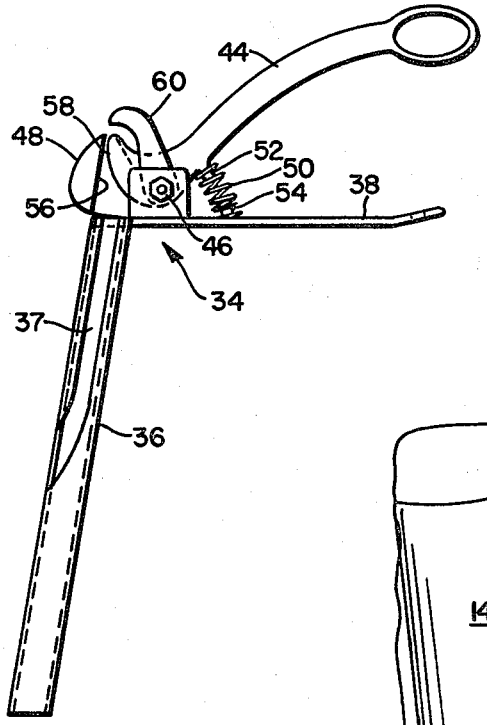
FIG. 4 is a side elevational view of one embodiment of the wireline protector of the present invention.

An exemplary downhole drilling system such as typically utilized in a directional drilling operation for correcting the alignment of the drilling path is illustrated in FIG. 1. At the bottom of the system is the drilling bit 2 that is driven by a downhole motor 4. Positioned immediately above the downhole motor is a sensing device 6 which senses the direction of movement of the drill bit so that signals can be fed back to the drill operators for correcting the path followed by the drill bit. The downhole motor is attached to the surface by a plurality of drill string members such as member 14 which form a drill string 12. The drilling assembly is shown within a drilled well bore hole 8 in the earth in FIG. 1.

The drill string assembly is driven by a kelly 16 which is held by a kelly bushing 22. Kelly bushing 22 is mounted on top of a rotary table 20. Rotary table 20 has an opening 42 through which the kelly passes so as to enter the drilled well bore hole 8. Rotary table 20 is arranged within rig floor 18. Since kelly 16 is secured against any relative rotational movement with respect to kelly bushing 22, by rotating the rotational table 20 and hence kelly bushing 22, kelly 20 is simultaneously rotated.

During the downhole drilling operation, an electrical wireline 24 is connected to sensing device 6 for supplying signals to and receiving signals back from the sensing device. Electrical wireline 24 passes through the opening in the rotary table so as to travel along well bore hole 8. Electrical wireline 24 enters the drill string assembly through a side entry sub assembly 26. The electrical wireline then travels through the drill string assembly unit it is hooked up to sensing device 6. That portion of the electrical wireline passing through the drill string is designated as electrical wireline 10 in FIG. 1.

During the drilling operation, the entire drill string assembly including the kelly advances into the hole being drilled. When the top portion of the kelly reaches the kelly bushing, additional drill string members must be added. For this purpose, the kelly along with the kelly bushing are retracted so as to draw the drill string assembly up from the well bore hole being drilled. The kelly is retracted until the uppermost portion of the top drill string member passes through the rotary table. A plurality of slip members 28, 30 and 32, as shown in FIG. 2, are inserted in the opening in the rotary table so as to secure drill string member 14 to the rotary table. The opening 42 in the rotary table preferably has a conical shape with the smaller portion being at the bottom, as shown in FIG. 3, and the slip members similarly should be conically shaped. With such a formation, the weight of the drill string assembly results in a force in a downward direction that creates a stronger attachment between the slip members and the inner walls of opening 42 in the rotary table so that the drill string assembly is securely fastened to the rotary table.

Before the drill string assembly has been securely fastened to the rotary table, a wireline protector 34 is inserted and electrical wireline 24 is placed and clamped within an elongated portion 36 of wireline protector 34. By inserting electrical wireline 24 in elongated portion 36 of wireline protector 34, electrical wireline 24 is effectively encased so that it is protected against any slippage of the slip members.

In order to prevent the wireline protector from slipping through the opening in the rotary table, attached to elongated section 36 is a transverse section 38. Transverse section 38 extends approximately perpendicular to elongated section 36. Transverse section 38 rests on top of the rotary table and elongated section 36 extends along the inner conically shaped wall of the rotary table as shown in FIG. 3. In order to make it easier to withdraw wireline protector 34 when the drilling operation is resumed, a rope or chain 40 is attached to the end of transverse section 38 to the wireline protector.

Once the wireline protector is inserted into opening 42 in the rotary table, in order to prevent any rotational movement of the wireline protector, it is desirable to make the outer circumference of the elongated section in the form of a parallelogram so that the sides are flat. Such a form for the elongated section inhibits any rotational movement of the wireline protector.

After the kelly has been detached from the uppermost portion of the top drill string member and the wireline protector inserted in place, the additional drill string members are added. After they are tightly secured between the kelly and the drill string assembly, the slips are removed and the drilling operation is resumed. Upon resuming the drilling operation, the wireline protector can be removed from opening 42 in the rotary table.

Two different embodiments of the wireline protector of the present invention are illustrated in FIGS. 4 and 8. Turning first to the preferred embodiment which is shown in FIG. 4, it is seen that wireline protector 34 has an elongated section 36 and a transverse section 38 with the angle between such being approximately 100°. Elongated section 36 has a slot 37 the opening of which turns by 90 degrees as it extends along elongated section 36. At the top end 39 of slot 37 there is a clamping mechanism for securely holding the wireline 24 once inserted into the slot 37.

The clamping mechanism of wireline protector 34 includes a movable clamping member 44 and a fixed clamping member 48. The wireline once inserted into slot 37 is also inserted into the space between clamping members 44 and 48 so that it is grasped by clamping surfaces 56 and 58. Clamping member 44 is pivotable about pivoting rod 46 and is spring biased by spring 50 so that clamping surface 58 is biased towards clamping surface 56. Spring 50 is attached between nub 52 on clamping member 44 and nub 54 on transverse member 38 so that the spring provides the appropriate biasing force. In order to insert wireline 24 between the two clamping surfaces, clamping member 44 is pressed in a downward direction against the force of spring 50 so as to increase the space between clamping surfaces 56 and 58. The wireline is then inserted between the clamping surfaces and the force on clamping member 44 is released. Once the clamping member 44 is released, the force of spring 50 pivots clamping member 44 and causes the two clamping members to clamp wireline 24. After the wireline has been inserted between the two clamping members, locking, or latch, member 60 which is pivotable about pivoting rod 46 can be pivoted so as to block off the end opening of the clamping members. Locking member 60 then prevents wireline 24 from slipping out of the clamping mechanism.

Figure 6:
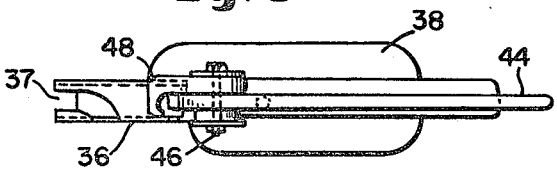
FIG. 6 is a top plan view of the wireline protector illustrated in FIG. 4.
Figure 7:
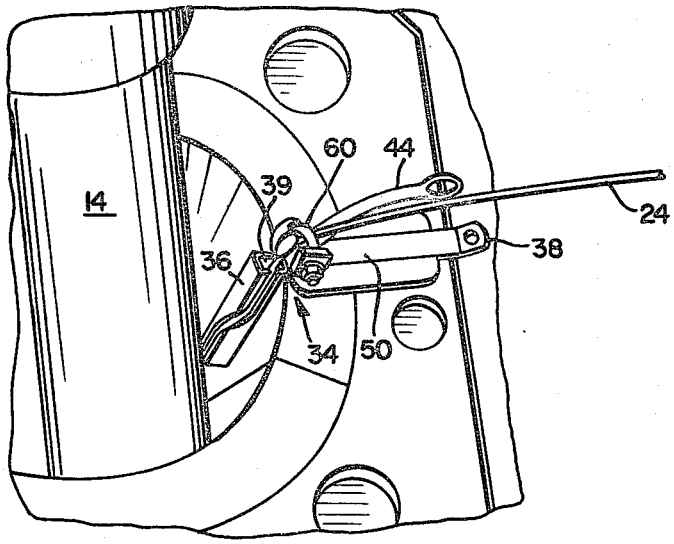
FIG. 7 is a perspective view of one embodiment of a wireline protector of the present invention arranged on the rotary table for use during the procedure of adding a drill string member.
Figure 5:
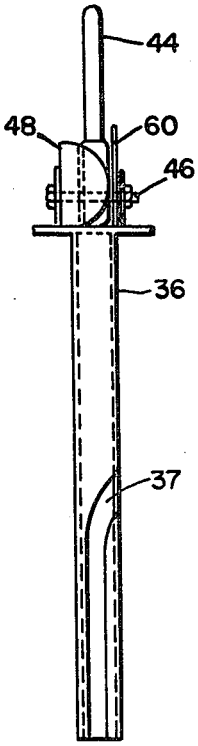
FIG. 5 is a front elevational view of the wireline protector of FIG. 4.

As shown in FIG. 6, clamping member 48 is curved so that once locking member 60 is rotated in a downward direction wireline 24 is enclosed on all sides at the location of the clamping mechanism. FIG. 7 illustrates wireline protector 34 when in use during the operation of adding additional drill strings to the drilling rig. In this illustration of FIG. 7, for the sake of clarity the slip members 28, 30 and 32 have been left out.

Figure 9:
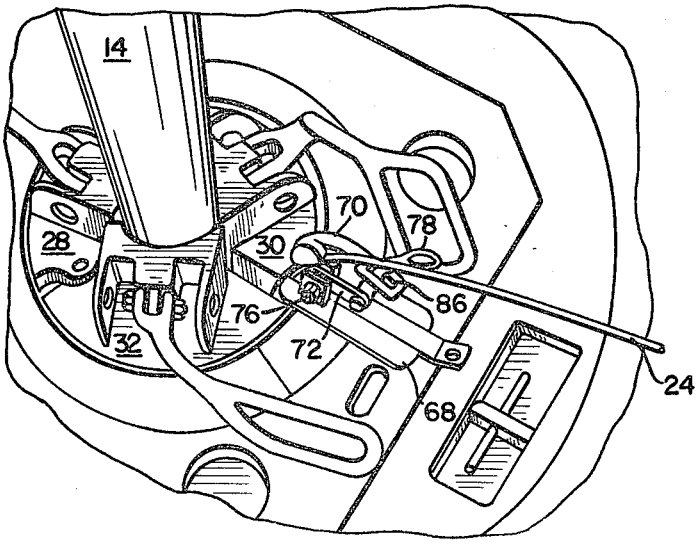
FIG. 9 is a perspective view of the embodiment of the wireline protector of FIG. 8 when the protector is in use during a drilling operation.

A second embodiment of the wireline protector of the present invention is shown in FIGS. 8 and 9 by wireline protector 62. In this embodiment of the wireline protector, instead of the clamping force being provided by upward movement of a pivotable arm which is spring biased for such movement, the clamping force is provided by pivoting an arm in a downward direction towards the fixed clamping member.

Wireline protector 62 has an elongated section 64 with a slot 66 and a transverse section 68. Arranged at the top of elongated section 64 is the clamping mechanism of this wireline protector. The clamping mechanism includes a movable clamping member 70 and a fixed clamping member 72. Movable clamping member 70 is attached to a pivoting arm 74 which is pivoted about pivoting rod 76. Pivoting motion of pivoting arm 74 in a clockwise direction will cause clamping surface 82 to move towards clamping surface 84 so as to clamp a wireline 24 between these two clamping surfaces. In order to create the pivoting force, a locking member 78 which is secured about a pivoting rod 80 passes through an opening 86 in clamping member 70 such as shown in FIGS. 8 and 9. FIG. 9 illustrates wireline protector 62 when in use during the operation of adding addition drill string members. By pulling back on locking member 78 so as to cause such member to rotate about pivot rod 80, a force is applied to clamping member 70 which in turn along with pivoting arm 74 will be pivoted so as to cause clamping surface 82 to move towards clamping surface 84. Such movement in turn causes the clamping surfaces to firmly grasp the wireline when arranged between such surfaces.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A wireline protector for protecting an electrical wireline used in a downhole drilling operation where such wireline passes through the opening in a drilling rotary table through which the drill string passes, said wireline protector comprising: an elongated section capable of extending through the opening in the rotary table without interfering with the drill string, said elongated section having an elongated opening into which the portion of the wireline passing through the rotary table can be inserted so as to be substantially surrounded by said elongated section for protecting the wireline; a second section extending approximately perpendicularly to said elongated section and capable of being arranged in engagement with the rotary table for maintaining said wireline protector in place; and clamping means capable of clamping the wireline for preventing its movement.

2. A wireline protector according to claim 1 wherein said clamping means is arranged along said elongated section and clamps the wireline within said elongated section.

3. A wireline protector according to claim 2 wherein said clamping means includes a first member and a second member, said second member being movable towards said first member for clamping the wireline between said first and second members, and means for locking the wireline in place between said first and second members when said first and second members are to clamp the wireline.

4. A wireline protector according to claim 3 wherein said clamping means further includes spring biasing means for biasing said second member towards said first member.

5. A wireline protector according to claim 1 or 4 wherein the circumference of said elongated section is non-circular so as to avoid any tendency for said wireline protector to roll within the opening in the rotary table.

6. A wireline protector according to claim 5 wherein said second section and said elongated section are respectively oriented so as to encompass an angle of approximately 100°.

7. A wireline protector according to claim 6 wherein the access of said elongated opening extends along a path that turns between the two longitudinal ends of said elongated section.

8. A wireline protector according to claim 7 wherein said path turns by approximately 90°.

9. A method for adding drill string members in a downhole drilling assembly, such assembly including: a downhole drilling motor, an electrical sensing member, a drill string having at least one drill string member, a kelly attached to the upper end of the drill string, a rotary table having an opening through which the kelly and the drill string extends, and a supply of electrical wireline, which wireline extends through the opening in the rotary table; the method comprising the steps of: raising the kelly and the drill string when another drill string member is to be attached, with the drill string being raised sufficiently so that the top portion of the uppermost drill string member extends through the opening in the rotary table; inserting slip members between the uppermost drill string member and the rotary table for securing the drill string to the rotary table; inserting a wireline protector through the opening in the rotary table, such wireline protector having an elongated opening; placing the portion of the electrical wireline extending through the opening in the rotary table into the elongated opening in the wireline protector for protecting the electrical wire from the slip members and the drill string; and clamping the electrical wireline within the wireline protector for preventing movement of the electrical wireline.

10. A method according to claim 9 further comprising the step of retaining the electrical wire in the wireline protector while a drill string member is being attached.

11. A method according to claim 10 further comprising the steps of unclamping the electrical wireline from the wireline protector and removing the wireline protector after the additional drill string member has been attached.

12. A wireline protector for protecting an electrical wireline used in a downhole drilling operation where such wireline passes through the opening in a drilling rotary table through which the drill string passes, said wireline protector comprising: an elongated section capable of extending through the opening in the rotary table without interfering with the drill string, said elongated section having an elongated opening into which the portion of the wireline passing through the rotary table can be inserted so as to be substantially surrounded by said elongated section for protecting the wireline, the access of said elongated opening extends along a path that turns between the two longitudinal ends of said elongated section; a second section extending approximately perpendicularly to said elongated section and capable of being arranged on the rotary table for maintaining said wireline protector in place; and clamping means for clamping the wireline within said elongated section and locking such wireline within said elongated section.

13. A wireline protector according to claim 12 wherein the circumference of said elongated section is non-circular so as to avoid any tendency for said wireline protector to roll within the opening in the rotary table.

14. A wireline protector according to claim 13 wherein said second section and said elongated section are respectively oriented so as to encompass an angle of approximately 100°.

15. A wireline protector according to claim 14 wherein the cross-sectional shape of said elongated opening is a parallelogram.

* * * * *